US005617750A

United States Patent [19]

Preddey

[11] Patent Number: 5,617,750

[45] Date of Patent: Apr. 8, 1997

[54] PIN TUMBLER LOCKS AND KEYS THEREFOR

[75] Inventor: Brian Preddey, New South Wales, Australia

[73] Assignee: Master Locksmiths Assoc. of Australasia Limited, Victoria, Australia

[21] Appl. No.: 67,536

[22] Filed: May 26, 1993

[30] Foreign Application Priority Data

May 27, 1992 [AU] Australia ..... PL2648

[51] Int. Cl.[6] ..... E05B 15/00

[52] U.S. Cl. ..... 70/419; 70/421; 70/495; 70/356

[58] Field of Search ..... 70/356–358, 386, 70/401, 405–407, 409, 419–421, 490, 492, 493, 495, 496

[56] References Cited

U.S. PATENT DOCUMENTS

| | | | |
|---|---|---|---|
| 2,087,554 | 7/1937 | Schoorel | 70/364 |
| 2,149,733 | 3/1939 | Hagendorn et al. | 70/364 |
| 2,578,211 | 12/1951 | Spain | 70/419 X |
| 2,648,973 | 8/1953 | Spain | 70/419 X |
| 2,666,322 | 1/1954 | Uher | 70/419 |
| 3,479,849 | 11/1969 | Check | 70/419 X |
| 3,507,133 | 4/1970 | Basseches | 70/421 |
| 4,213,316 | 7/1980 | Tietz | 70/421 X |
| 4,377,082 | 3/1983 | Wolter | 70/395 X |
| 4,393,673 | 7/1983 | Widen | 70/358 |
| 4,434,636 | 3/1984 | Prunbauer | 70/358 |
| 4,608,842 | 9/1986 | Tietz | 70/358 |
| 4,638,651 | 1/1987 | Surko, Jr. | 70/495 |
| 4,753,091 | 6/1988 | Sheets | 70/419 |
| 5,050,412 | 9/1991 | Errani | 70/358 |
| 5,079,936 | 1/1992 | Stefanek | 70/358 |

FOREIGN PATENT DOCUMENTS

| | | | |
|---|---|---|---|
| 444972 | 9/1991 | European Pat. Off. | 70/420 |
| 705153 | 6/1931 | France | 70/358 |
| 959135 | 3/1950 | France | 70/356 |
| 2280772 | 2/1976 | France . | |
| 3225952 | 1/1984 | Germany | 70/405 |
| 4035934 | 6/1991 | Germany | 70/356 |
| 112761 | 1/1918 | United Kingdom . | |

OTHER PUBLICATIONS

UK Patent Abstracts –GB 2 223 054 A, Mar. 28, 1990 re 8822199.9.

*Primary Examiner*—Suzanne L. Dino
*Attorney, Agent, or Firm*—Cushman Darby & Cushman IP Group of Pillsbury Madison & Sutro LLP

[57] ABSTRACT

The invention relates to an improvement in a key-actuated pin tumbler lock of the type having: a cylindrical core rotatable in a lock housing via a rotational path, a plurality of pin tumblers received in bores journalled in the core and lock housing, each bore containing a set of pin tumblers comprising one core pin and one housing pin, biassed towards the core, and having a pin junction therebetween, and a key slot in the core, whereby insertion in the key slot of a key having thereon suitable bits is adapted to align the pin junctions with the rotational path of the core in the lock housing, and to permit the core to rotate within the housing. The improvement comprises a retaining mechanism adapted to bias at least one of the pin tumblers towards engagement with the rotational path of the core, the mechanism being adapted to restrain rotation of the core until release of the or each biassed pin tumbler upon insertion of a key including, as well as the suitable bits, means for disengaging the retaining mechanism from engagement with the or each biassed pin tumbler.

17 Claims, 6 Drawing Sheets

PIN TUMBLER LOCKS AND KEYS THEREFOR

This invention relates to key-actuated locks of the pin tumbler type.

This type of lock has a cylindrical core rotatable in a lock housing, there being a plurality of pin tumblers received in bores journalled in the core and in the lock housing. The pin tumblers are of two types: core pins and housing pins. Each bore contains a set of one core pin and one housing pin, biassed towards the core. A key slot is formed in the core. Insertion of a key having the correct notches or bits aligns the junction between each set of core and housing pins with the rotational path of the core in the housing, and the core is permitted to rotate within the housing, thus unlocking the latch or the like on which the lock operates. If the incorrect key is inserted, the rotational path is blocked by one or more pins and the core cannot rotate.

BACKGROUND ART

This type of lock is susceptible to unauthorised opening, especially by use of keys milled or filed to resemble the correct key. This lock is also susceptible to "picking" to achieve unauthorised opening. Consequently, many systems have been proposed to ensure that the lock can be operated only by insertion of the correct key.

For example, U.S. Pat. No. 4,213,316 (Tietz) uses, as well as pin tumblers, supplementary pins located in bores in the core and biassed towards the centre thereof. To operate this lock it is necessary to use a key with two opposed locking ribs of the correct depth. These contact the supplementary pins and align them to abut the rotational path of the core. If the ribs are of insufficient depth, the supplementary pins will be short of abutment with the rotational path and, after a certain degree of rotation of the core, a pin tumbler, which is in the same plane as the supplementary pins, will partially enter the supplementary pin bore and jam further rotation of the core.

In U.S. Pat. No. 4,434,636 (Evva-Werk), the lock includes, as well as the conventional tumbler pins, auxiliary tumbler elements movable at an oblique angle relative to the keyway and being engageable at one end in arresting recesses in the housing.

U.S. Pat. No 4,377,082 (DOM) also includes auxiliary tumblers actuated, in this case, by a rolling element in the key.

U.S. Pat. No. 4,608,842 (Zeiss Ikon) employs three types of auxiliary tumblers operated by a key with opposed ribs.

It will be appreciated that all these prior art locks involve the use of supplementary or auxiliary pins and therefore manufacture of these locks requires a substantial degree of engineering. Not only do these prior art locks cost a great deal more to produce, they are also susceptible to problems due to any imprecision in manufacture.

It is an object of the present invention to provide a lock which addresses many of the same problems as the prior art, but which provides solutions with relatively simple mechanisms. In particular, it is an object of this invention to provide such a lock which does not require auxiliary tumblers.

One continuing difficulty with locks of the pin tumbler type relates to key restriction systems. In many prior art arrangements, a key blank of unique profile is provided for a customer or manufacturer in order to control or prevent unauthorised key cutting for a particular group of locks.

However, the duplicating of keys usually involves the removal of material from the key blank. Under present conventional systems, key cutters may be able to locate an unrestricted key blank profile similar to a restricted key blank and to mill or file the unrestricted blank until it matches the restricted profile.

It is an object of the present invention to provide an arrangement and system such that a restricted key cannot be duplicated merely by removing material from a generally available profile.

It is a further object of this invention to provide a lock system in which, in one embodiment, insertion of an incorrect key can result in jamming of the lock.

BRIEF SUMMARY OF THE INVENTION

In its broadest form, the present invention comprises an improved key-actuated pin tumbler lock of the type having:

a cylindrical core rotatable in a lock housing via a rotational path, a plurality of pin tumblers received in bores journalled in the core and lock housing, each bore containing a set of pin tumblers comprising one core pin and one housing pin, biassed towards the core, and having a pin junction therebetween, and a key slot in the core, whereby insertion in the key slot of a key having thereon suitable bits is adapted to align the pin junctions with the rotational path of the core in the lock housing, and to permit the core to rotate within the housing, the improvement comprising a retaining mechanism adapted to bias at least one of the pin tumblers towards engagement with the rotational path of the core, the mechanism being adapted to restrain rotation of the core until release of the or each biassed pin tumbler upon insertion of a key including, as well as the suitable bits, means for disengaging the retaining mechanism from engagement with the or each biassed pin tumbler.

Preferably, the pin tumblers and bores are located in a single plane which is the same as the plane of the suitable bits on the key, and the disengagement means is located in a different plane.

In a particularly preferred embodiment, the disengagement means comprises a wing formed on the key, for example, at right angles to the plane in which the bits are located.

The retaining mechanism preferably includes a spring received in a groove located in the core and biassed towards engagement with one core pin. The retaining mechanism may also include release means such as a rotatable ball adapted to release the spring from engagement with the one core pin, under the influence of disengagement means on the key.

The spring may, of course, engage a plurality of core pins, there being provided a plurality of release means. However, for the sake of simplicity, this embodiment is generally described herein in connection with the engagement of one core pin. The invention is not so limited.

The improved lock of the invention may further include a locking bar, such as a trap received within a recess in the core and, in the locked position, adapted to extend through the rotational path into a side bar cavity in the lock housing, the trap being adapted to be withdrawn from the side bar cavity and the rotational path by means of withdrawal means on the key. The withdrawal means preferably comprise a notch or the like cut into the wing of the key, the trap being biassed towards the core.

It will be immediately apparent to one skilled in the art that, by including a plurality of retaining mechanisms and locking bars, it is possible to greatly increase the number of possible permutations in the look and key combinations of the present invention.

It will also be apparent to one skilled in the art that a special key blank is required to cut a key for operating the lock of the present invention. Such a key blank is novel in that it need include only a single wing. Accordingly, this invention also provides a key blank suitable for manufacturing the key for operating the improved lock of the invention, the key blank having in one plane a shank in which the suitable bits may be formed and in a different plane a wing comprising the disengagement means or in which the disengagement means may be formed.

Preferably, as already indicated, the plane of the wing is at right angles to the plane of the shank. The wing may extend for substantially the length of the shank or may extend for a lesser distance.

This invention also provides a key for operating the improved lock of the invention, the key having in one plane a shank having formed therein the suitable bits and in a different plane a wing comprising or containing the disengagement means.

The invention also provides the combination of the improved lock of the invention and a key adapted for insertion in the key slot, the key including, as well as the suitable bits, means for disengaging the retaining mechanism from engagement with the or each biassed pin tumbler.

BRIEF DESCRIPTION OF THE DRAWINGS

Certain embodiments of the invention will now be described in more detail with reference to the accompany drawings, in which.

Figure 1A:
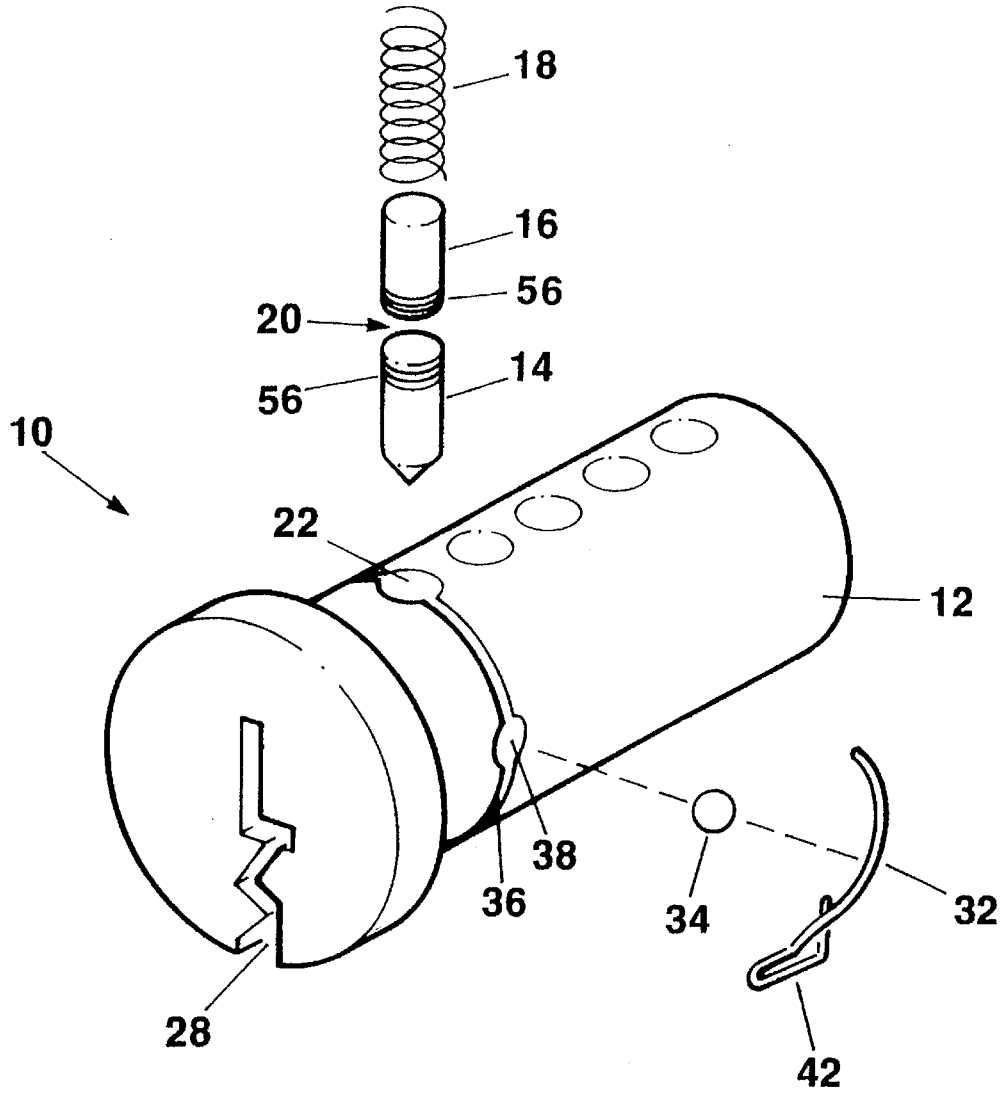
FIG. 1*a* is a partially exploded perspective view of a lock embodying the invention.

Referring first to FIG. 1*a*, in this embodiment the pin tumbler lock indicated generally at 10 has a largely conventional cylindrical core 12 and a number of pin tumblers, one pair of which is illustrated as core pin 14 and housing pin 16, biassed towards core 12 by spring 18 (only one of which is shown). Core pin 14 and housing pin 16 meet at pin junction 20.

Pin tumblers 14 and 16 are received in bores 22 in core 12 and in colinear bores 23 (see FIG. 3) in lock housing 24.

Figure 5:
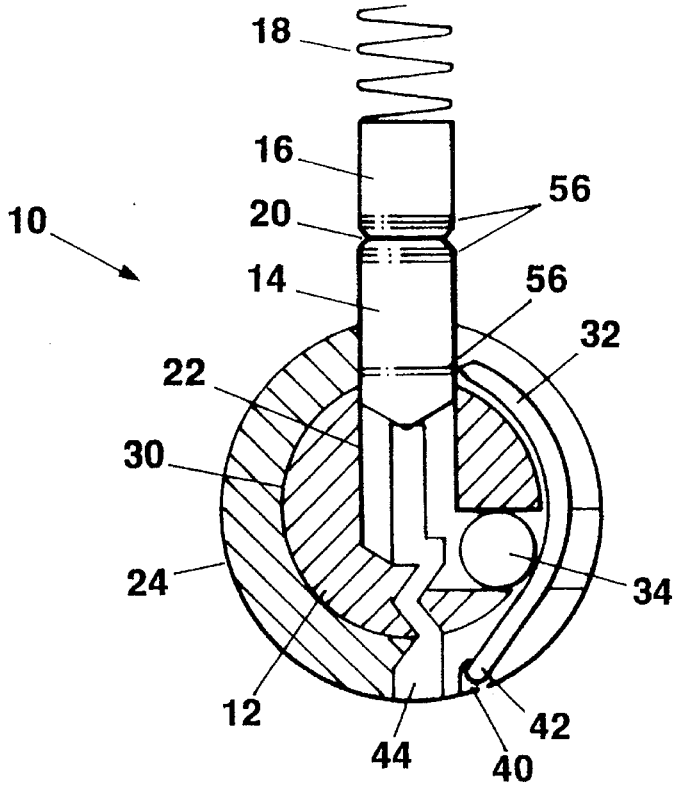
FIG. 5 shows, in similar partial cross-section, the lock when a key of incorrect profile is inserted.

Key slot 28 extends through core 12. FIG. 5, for example, illustrates the rotational path 30 of core 12 in housing 24.

Figure 1B:
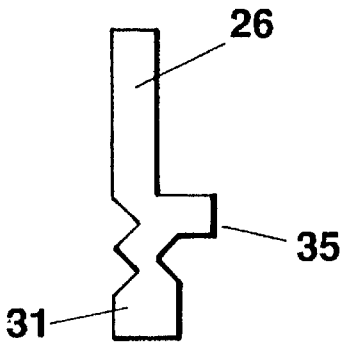
FIG. 1*b* is a cross-section of a correctly-profiled key for the lock of FIG. 1.
Figure 8:
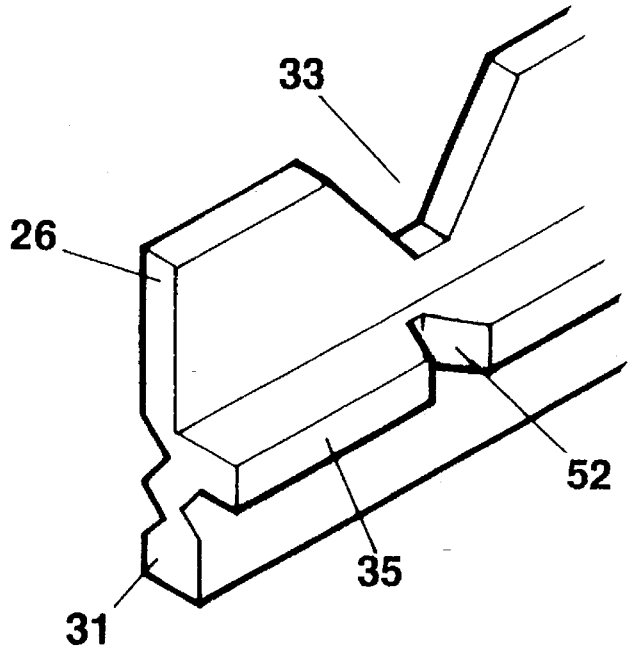
FIG. 8 illustrates part of a key of the present invention.

Key 31 in FIG. 1*b* has conventional bits 33 (refer FIG. 8 in which one bit 33 is shown) formed in shank 26 as well as disengagement means comprising a wing 35 of approximately 1 mm in depth.

Figure 1C:
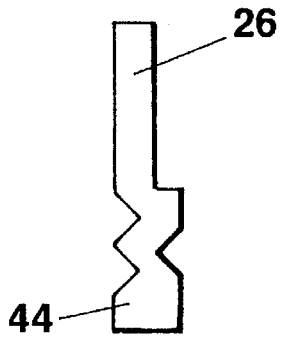
FIG. 1*c* is a cross-section of an incorrectly-profiled key for the lock of FIG. 1.
Figure 2:
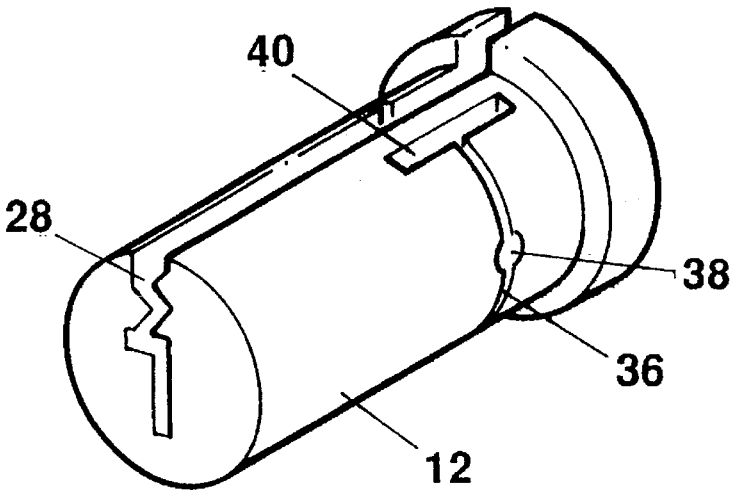
FIG. 2 shows an inverse view of the lock of FIG. 1.

Key 44 in FIG. 1*c* has conventional bits (not shown) formed in shank 26 but lacks a wing.

Pin tumblers 14 and 16 and bores 22 are located in the vertical plane, while wing 35 is in the horizontal plane.

Spring 32 and ball 34 together comprise the retaining mechanism. Spring 32 is received in a relatively shallow (for instance, 1 mm deep) groove 36 which extends around the circumference of core 12. Groove 36 includes a hole 38 for receiving ball 34. Tension key 42 of spring 32 is anchored in base 40.

Figure 3:
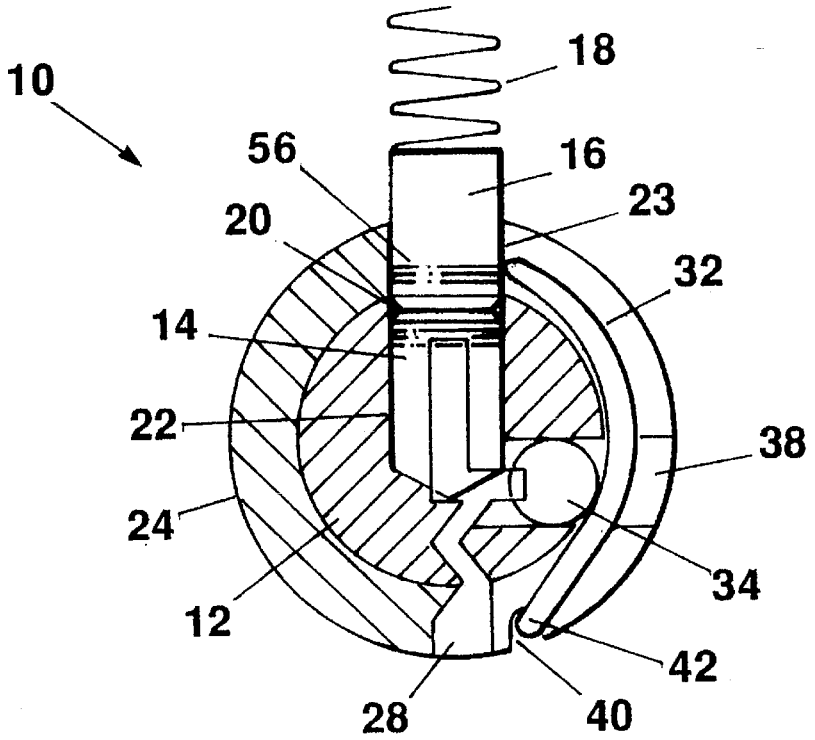
FIG. 3 is a partial cross-sectional view of the lock of FIG. 1, in the locked position.

Referring now to FIG. 3, this is a cross-section taken at the level of groove 36 and shows lock 10 in the normal locked position. Note that spring 32 engages pin 16. To enhance engagement, grooves 56 are provided on pins 14 and 16. Grooves 56 may of course be omitted in favour of frictional engagement between spring 32 and pin 14 or 16.

Figure 4:
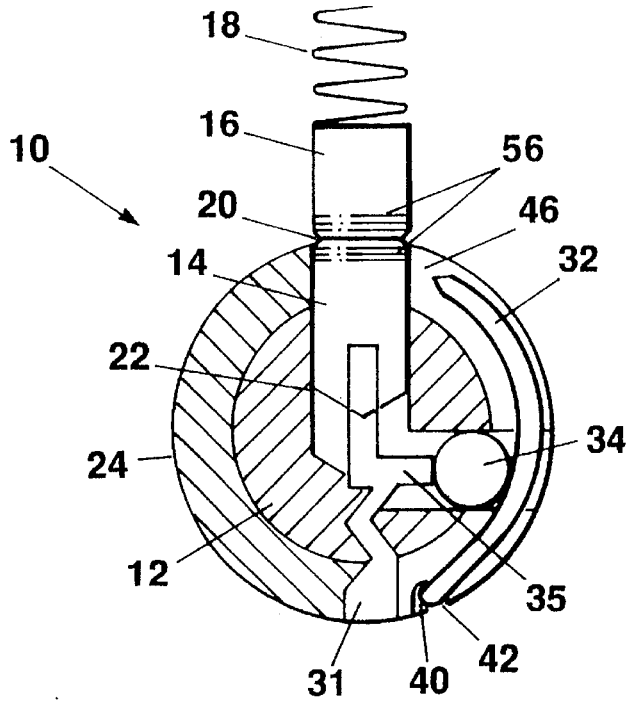
FIG. 4 shows, in a similar partial cross-section, the lock in the open position.

FIG. 4 illustrates lock 10 in an unlocked state when the correct key 31 is inserted. Because key 31 has the correct wing 35, ball 34 is forced to engage spring 32, so as to open gap 46 and allow core pin 14 and housing pin 16 to assume their correct orientation wherein pin junction 20 is aligned with rotational path 30 when key 31 is fully inserted.

In FIG. 5, an incorrect key 44 has been inserted. Because key 44 lacks wing 35, core pin 14 has been pushed up by insertion of key 44 but cannot assume its correct position, even for an otherwise correctly cut key. Spring 32 engages core pin 14 and interferes with it, thereby preventing core 12 from rotating in housing 24. (Extra grooves 56 are provided on the lower part of pin 14 to enhance engagement by spring 32. For clarity, these grooves are shown only in FIG. 5.) Lock 10 is jammed and cannot be opened until a correctly profiled key is inserted to reset core pin 14.

Figure 6:
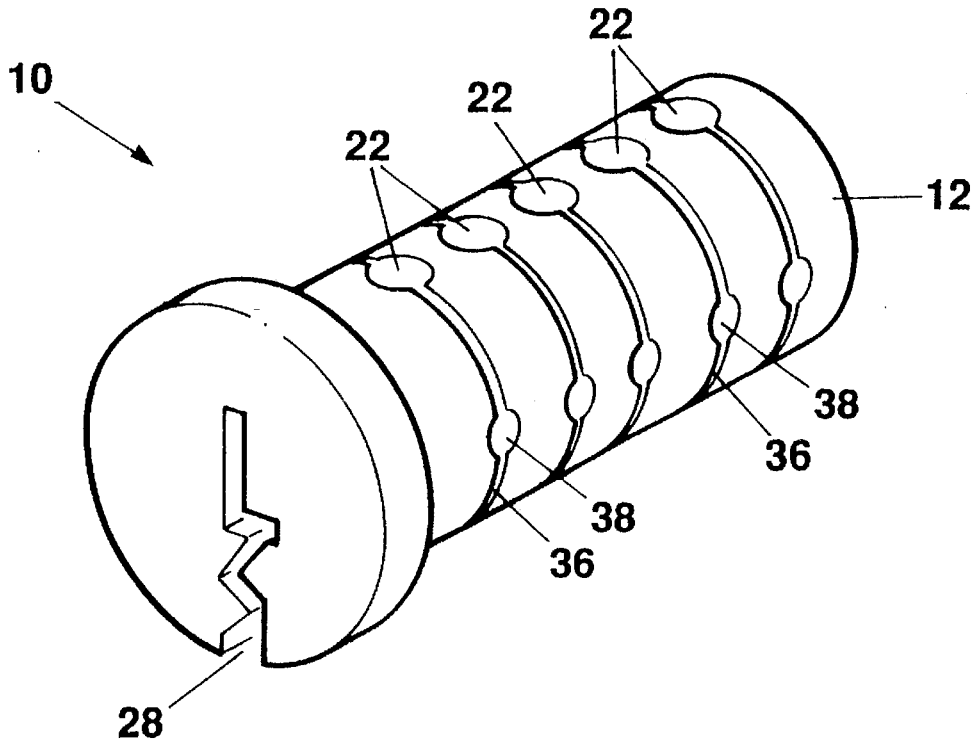
FIG. 6 illustrates in perspective view a variation of the lock of FIGS. 1 to 5, having a plurality of retaining mechanisms.

It will be appreciated that the lock of the present invention also provides improved pick resistance. The picking process is made considerably more complicated, since ball 34 must be held out while continuing the normal picking procedure on the tumblers. When more than one ball 34 and spring 32 is provided, either on the same or different parts of key slot 28, this can further frustrate picking. One such embodiment is shown in FIG. 6, omitting springs 32 and balls 34 for clarity.

Key 31 is capable of an enhanced number of combinations compared to prior art keys. For example, as illustrated, key 31 has wing 35 on the right hand side. As an alternative, key 31 may have wing 35 on the left hand side, with spring 32, ball 34 and groove 36, etc., also being on the left hand side of core 12. Bits 33 may be the same for both versions of key 31. However, a left land winged key would not operate a right-hand oriented lock, and vice versa. A master key with both left and right hand blades would operate both locks, provided key slot 28 was of the appropriate shape.

Turning now to FIGS. 7*a* to 7*d*, lock 10 has, as well as ball 34 which can push against spring 32, a trap 48 which is received in core 12 and which is receivable in a side bar recess in housing 24 (not shown).

Figure 7A:
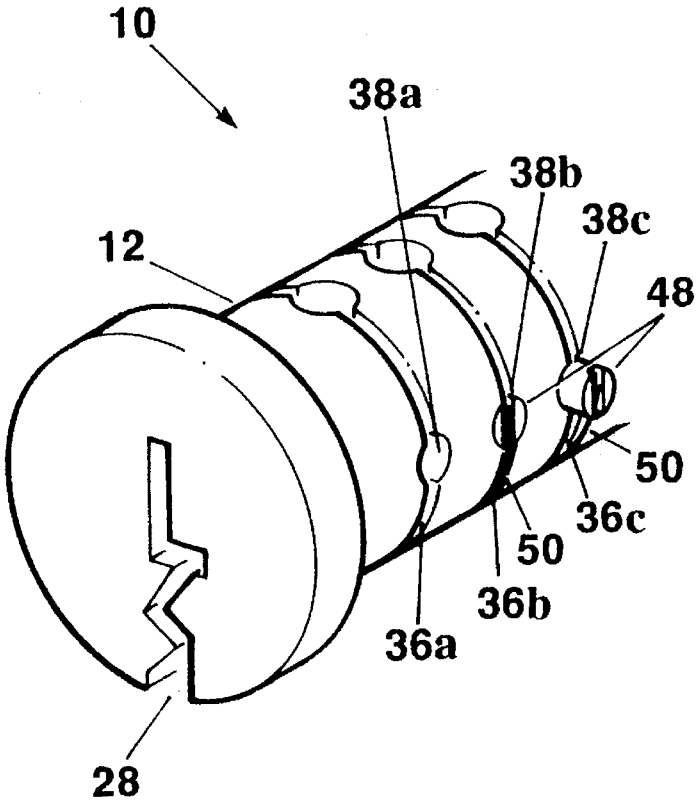
FIG. 7*a* shows in perspective view a lock of the invention including locking bars.

Ball 34 and spring 32 have been omitted from FIG. 7*a*, for clarity. Groove 36*a* is suitable to receive a spring 50 which is shorter than spring 32. Hole 38*a* is suitable to receive a trap 48. Groove 36*a* and hole 38*a* have been shown empty, for clarity.

Trap 48 received in hole 38*b* communicating with groove 36*b* is in the unlocked position, while trap 48 received in hole 38*c* communicating with groove 36*c* is in the locked position. Core 12 would include at least one spring 32 in a groove 36 and at least one ball 34 as in FIG. 1*a*, for example, but these have been omitted from FIG. 7*a* for clarity.

Figure 7B:
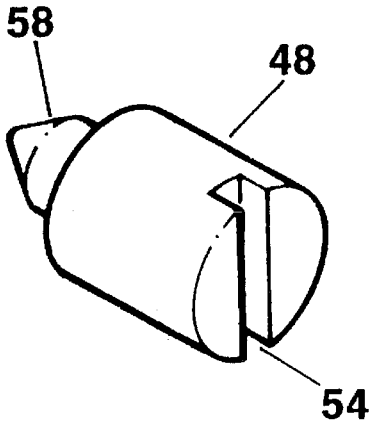
FIG. 7*b* is an enlarged view of a trap.

A detailed view of trap 48 is shown in FIG. 7*b*Trap 48 includes groove 54 in which is received spring 50, which biases trap 48 towards core 12.

Figure 7C:
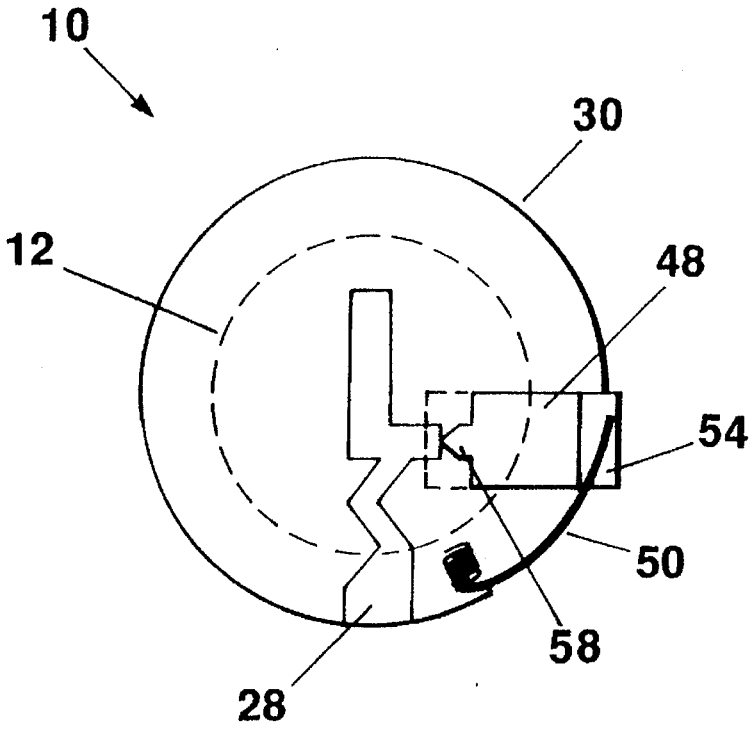
FIG. 7*c* shows in cross-sectional view the lock with the trap in the looked position.

When insertion of key 44 (see FIG. 8) commences in key slot 28, wing 35 pushes on end 58 of trap 48 and enables trap 48 to act as a locking bar to jam lock 10, as shown in groove 36*c* of FIG. 7*a* and in FIG. 7*c*.

Figure 7D:
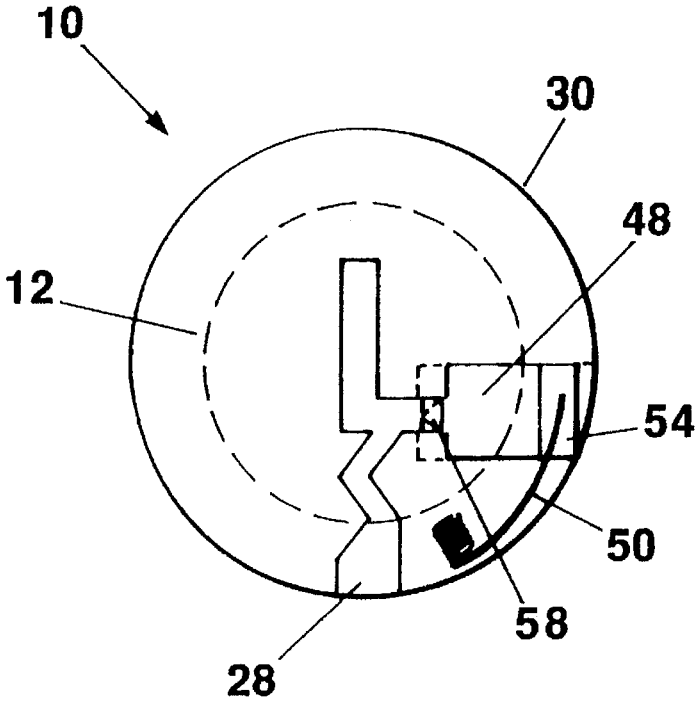
FIG. 7*d* shows in cross-sectional view the lock with the trap in the unlocked position.

Provided key 44 has the correctly located notch 52, as key 44 fully enters key slot 28, end 58 will enter notch 52 (the withdrawal means) under the influence of spring 50 and trap 48 will assume the position shown in FIG. 7*d*. Trap 48 then clears rotational path 30 of core 12 and permits operation of lock 10.

If key 44 is otherwise correct but lacks notch 52, lock 10 will be jammed.

As shown in FIG. 6, lock 10 may include a number of springs 32 and balls 34. Lock 10 may also include a number of traps 48. The correct key 31 includes the wing 35 appropriate to cause disengagement of all the springs 32 and also includes the notches 52 appropriate to release the traps 48.

It will be seen from the above description that the present invention avoids the problem encountered in the prior art of having to introduce auxiliary tumblers to achieve both a high level of security and also a large variation in lock and key combinations.

Variations and additions are possible within the spirit and scope of the invention, as will be apparent to those skilled in the art.

I claim:

1. A pin tumbler lock operable with a corresponding key, the lock comprising:

a lock housing;

a core rotatable within said lock housing along a rotational path, said lock housing and said core each having a bore formed therein, wherein said bore formed in said lock housing is alignable with said bore formed in said core, said core further including a key slot formed therein which is constructed and arranged to receive the corresponding key;

a pin tumbler movable in opposite directions in said bore formed in said core and said bore formed in said, lock housing, said pin tumbler including a core pin and a housing pin with a pin junction therebetween, wherein said pin tumbler is biassed towards said core; and a retaining mechanism constructed and arranged to selectively engage said pin tumbler to thereby prevent movement of said pin tumbler, said retaining mechanism comprising:

a spring having a first end fixedly connected to said core and a second end biassed toward said pin tumbler so as to engage said pin tumbler; and a displaceable member disposed within said core constructed and arranged to be displaceable by the insertion of the corresponding key into said key slot, said displaced displaceable member causing said second end of said spring to disengage from said pin tumbler.

2. The improved lock as claimed in claim 1, wherein the pin tumbler and bore are located in a first plane, and the disengagement means is located in a second plane.

3. The improved lock as claimed in claim 2, wherein the retaining mechanism includes a spring received in a groove located in the core and biassed towards engagement with the one pin tumbler.

4. The improved lock as claimed in claim 3, wherein the retaining mechanism further includes a a displaceable member constructed and arranged to release the spring from engagement with the one pin tumbler under influence of the disengagement means provided on the key.

5. The improved lock as claimed in claim 4, which further includes a locking bar comprising a trap received within a recess in the core and, in the locked position, adapted to extend through the rotational path into a side bar cavity in the lock housing, the trap being adapted to be withdrawn from the side bar cavity and the rotational path by means of withdrawal means provided on on the key.

6. The improved lock as claimed in claim 5, wherein the trap is biassed towards the core and is adapted to be urged towards the locked position by the disengagement means provided on the key.

7. The improved lock as claimed in claim 6, including a spring, a displaceable member, and a locking bar corresponding the pin tumbler.

8. A key blank suitable for manufacturing the key for operating the improved lock claimed in claim 2, the key blank having in the first plane a shank in which a plurality of suitable bits are formed and in the second plane a wing in which the disengagement means are formed.

9. A key blank as claimed in claim 8, wherein the second plane is at right angles to the first plane.

10. The lock as claimed in claim 1 further comprising a locking bar mechanism, wherein said lock housing includes a side bar cavity and said core includes a recess aligned with said side bar cavity, wherein a trap is slidably received in said recess provided in said core, said trap being displaceable so as to extend between said recess and said side bar cavity, thereby preventing rotation of said core within said lock housing.

11. The lock as claimed in claim 10, wherein said trap is biassed toward said core.

12. The lock as claimed in claim 1 further comprising a retaining mechanism biassed to engage the pin tumbler, thereby resisting movement of the pin tumbler in radially outward and radially inward directions within each said bore until released by insertion in the key slot of the key, the key including means for disengaging the retaining mechanism from the pin tumbler.

13. An improved key-actuated pin tumbler lock comprising the following:

a cylindrical core rotatable in a lock housing along a rotational path, a plurality of pin tumblers received in respective bores journalled in the core and the lock housing, each bore containing a pin tumbler including one core pin and one housing pin with a pin junction therebetween, each pin tumbler being biassed towards the core, a key slot in the core, whereby insertion in the key slot of a key having thereon suitable bits aligns the pin junctions of the plurality of pin tumblers with the rotational path of the core within the lock housing, thereby permitting the core to rotate within the lock housing, said pin tumblers, bores, and suitable bits on the key being located in a first plane, and the disengagement means is located in a second plane; and a retaining mechanism biassed to engage at least one of the pin tumblers, thereby resisting movement of the at least one pin tumbler in radially outward and radially inward directions within each said bore until released by insertion in the key slot of the key, the key including means for disengaging the retaining mechanism from the at least one pin tumbler, said retaining mechanism including a spring received in a groove located in the core and biassed towards engagement with the at least one pin tumbler, and said retaining mechanism further including a displaceable member constructed and arranged to release the spring from engagement with the at least one pin tumbler under influence of the disengagement means provided on the key.

14. An improved key-actuated pin tumbler lock comprising the following:

a cylindrical core rotatable in a lock housing along a rotational path, a plurality of pin tumblers received in respective bores journalled in the core and the lock housing, each bore containing a pin tumbler including one core pin and one housing pin with a pin junction therebetween each pin tumbler being biassed towards the core, a key slot in the core, whereby insertion in the key slot of a key having therein suitable bits aligns the pin junctions of the plurality of pin tumblers with the rotational path of the core within the lock housing, thereby permitting the core to rotate within the lock housing, said pin tumblers, bores, and suitable bits on the key being located in a first plane, and the disengagement means is located in a second plane;

a retaining mechanism biassed to engage at least one of the pin tumblers, thereby resisting movement of the at least one pin tumblers in radially outward and radially inward directions within each said bore until released by insertion in the key slot of the key, the key including means for disengaging the retaining mechanism from the at least one pin tumbler, said retaining mechanism including a spring received in a groove located in the core and biassed towards engagement with the at least one pin tumbler, and said retaining mechanism further including a displaceable member constructed and arranged to release the spring from engagement with the at least one pin tumbler under influence of the disengagement means provided on the key; and a locking bar comprising a trap received within a recess in the core and, in the locked position, adapted to extend through the rotational path into a side bar cavity in the lock housing, the trap being adapted to be withdrawn from the side bar cavity and the rotational path by means of withdrawal means provided on the key.

15. An improved key-actuated pin tumbler lock comprising the following:

a cylindrical core rotatable in a lock housing along a rotational path, a plurality of pin tumblers received in respective bores journalled in the core and the lock housing, each bore containing a pin tumbler including one core pin and one housing pin with a pin junction therebetween, each pin tumbler being biassed towards the core, a key slot in the core, whereby insertion in the key slot of a key having thereon suitable bits aligns the pin junctions of the plurality of pin tumblers with the rotational path of the core within the lock housing, thereby permitting the core to rotate within the lock housing, said pin tumblers, bores, and suitable bits on the key being located in a first plane, and the disengagement means is located in a second plane;

a retaining mechanism biassed to engage at least one of the pin tumblers, thereby resisting movement of the at least one pin tumbler in radially outward and radially inward directions within each said respective bore until released by insertion in the key slot of the key, the key including means for disengaging the retaining mechanism from the at least one pin tumbler, said retaining mechanism including a spring received in a groove located in the core and biassed towards engagement with the at least one pin tumbler, and said retaining mechanism further including a displaceable member constructed and arranged to release the spring from engagement with the at least one pin tumbler under influence of the disengagement means provided on the key; and a locking bar comprising a trap received within a recess in the core and, in the locked position, adapted to extend through the rotational path into a side bar cavity in the lock housing, the trap being adapted to be withdrawn from the side bar cavity and the rotational path by means of withdrawal means provided on the key, with the trap being biassed towards the core and being adapted to be urged towards the locked position by the disengagement means.

16. An improved key-actuated pin tumbler lock comprising the following:

a cylindrical core rotatable in a lock housing along a rotational path, a plurality of pin tumblers received in respective bores journalled in the core and the lock housing, each bore containing a pin tumbler including one core pin and one housing pin with a pin junction therebetween, each pin tumbler being biassed towards the core, a key slot in the core, whereby insertion in the key slot of a key having thereon suitable bits aligns the pin junctions of the plurality of pin tumblers with the rotational path of the core within the lock housing, thereby permitting the core to rotate within the lock housing, said pin tumblers, bores, and suitable bits on the key being located in a first plane, and the disengagement means is located in a second plane;

a retaining mechanism biassed to engage at least one of the pin tumblers, thereby resisting movement of the at least one pin tumbler in radially outward and radially inward directions within each said respective bore until released by insertion in the key slot of the key, the key including means for disengaging the retaining mechanism from the at least one pin tumbler, said retaining mechanism including a spring received in a groove located in the core and biassed towards management with the at least one pin tumbler, and said retaining mechanism further including a displaceable member constructed and arranged to release the spring from engagement with the at least one pin tumbler under influence of the disengagement means provided on the key;

a locking bar comprising a trap received within a recess in the core and, in the locked position, adapted to extend through the rotational path into a side bar cavity in the lock housing, the trap being adapted to be withdrawn from the side bar cavity and the rotational path by means of withdrawal means provided on the key, with the trap being biassed towards the core and being adapted to be urged towards the locked position by the disengagement means; and wherein said lock includes a spring, a displaceable member, and a locking bar corresponding to each pin tumbler of said plurality of pin tumblers.

17. An improved key-actuated pin tumbler lock comprising the following:

a cylindrical core rotatable in a lock housing along a rotational path, a plurality of pin tumblers received in respective bores journalled in the core and the lock housing, each bore containing a pin tumbler including one core pin and one housing pin with a pin junction therebetween, each pin tumbler being biassed towards the core, a key slot in the core, whereby insertion in the key slot of a key having thereon suitable bits aligns the pin junctions of the plurality of pin tumblers with the rotational path of the core within the lock housing, thereby permitting the core to rotate within the lock housing, said pin tumblers, bores, and suitable bits on the key being located in a first plane, and the disengagement means is located in a second plane; and a retaining mechanism biassed to engage at least one of the pin tumblers, thereby resisting movement of the at least one pin tumbler in radially outward and radially inward directions within each said respective bore until released by insertion in the key slot of the key, the key including means for disengaging the retaining mechanism from the at least one pin tumbler, said retaining mechanism including a spring received in a groove located in the core and biassed towards engagement with the at least one pin tumbler, and said retaining mechanism further including a displaceable member which is a ball member constructed and arranged to release the spring from engagement with the at least one pin tumbler under influence of the disengagement means provided on the key.

* * * * *